US009161122B2

(12) United States Patent
Tseng et al.

(10) Patent No.: US 9,161,122 B2
(45) Date of Patent: Oct. 13, 2015

(54) APPARATUS FOR DIFFERENTIAL INTERPOLATION PULSE WIDTH MODULATION DIGITAL-TO-ANALOG CONVERSION AND OUTPUT SIGNAL CODING METHOD THEREOF

(71) Applicant: TRITAN TECHNOLOGY INC., Hsinchu (TW)

(72) Inventors: Ching-Hung Tseng, Hsinchu (TW); Shen-Yu Peng, Hsinchu (TW)

(73) Assignee: TRITAN TECHNOLOGY INC., Hsinchu (TW)

( * ) Notice: Subject to any disclaimer, the term of this patent is extended or adjusted under 35 U.S.C. 154(b) by 457 days.

(21) Appl. No.: 13/654,646

(22) Filed: Oct. 18, 2012

(65) Prior Publication Data

US 2014/0112493 A1 Apr. 24, 2014

(51) Int. Cl.
*H04R 3/00* (2006.01)

(52) U.S. Cl.
CPC ..... *H04R 3/00* (2013.01)

(58) Field of Classification Search
CPC ..... H04R 3/00; H04R 3/002; H04R 2400/13; G10L 19/097; G10L 19/16
USPC ..... 381/73.1
See application file for complete search history.

(56) References Cited

U.S. PATENT DOCUMENTS

| | | | | |
|---|---|---|---|---|
| 7,170,266 | B1 * | 1/2007 | Seven et al. | 323/268 |
| 2003/0006837 | A1 * | 1/2003 | Score et al. | 330/10 |
| 2006/0103458 | A1 * | 5/2006 | Hansen et al. | 330/10 |
| 2007/0132509 | A1 * | 6/2007 | Mochizuki | 330/10 |
| 2009/0021305 | A1 * | 1/2009 | Komatsu | 330/251 |
| 2009/0022327 | A1 * | 1/2009 | Braun | 381/1 |
| 2009/0289709 | A1 * | 11/2009 | Khoury et al. | 330/251 |
| 2010/0045376 | A1 * | 2/2010 | Soenen et al. | 330/251 |
| 2011/0261875 | A1 * | 10/2011 | Alexander et al. | 375/238 |

* cited by examiner

*Primary Examiner* — Simon Sing
(74) *Attorney, Agent, or Firm* — Lin & Associates IP, Inc.

(57) ABSTRACT

A differential interpolation pulse width modulation (iPWM) digital to analog converter is provided, including an iPWM module for generating differential pulses from an input digital audio data stream, a power driver for providing energy to a terminal load and a filter for removing unwanted harmonic signals to reconstruct an analog signal, wherein the iPWM module further includes a PWM pulse generator to convert the digital input numerical code to a series of time domain pulses; an interpolation unit to increase the time domain resolution of the pulses; a self-calibration unit to maintain the pulse-width accuracy of the interpolation unit; a differential pulse width generator to convert the series of time domain pulses into voltage and time domain differential form.

3 Claims, 18 Drawing Sheets

APPARATUS FOR DIFFERENTIAL INTERPOLATION PULSE WIDTH MODULATION DIGITAL-TO-ANALOG CONVERSION AND OUTPUT SIGNAL CODING METHOD THEREOF

FIELD OF THE INVENTION

The present invention generally relates to an apparatus for differential interpolation pulse width modulation (iPWM) digital-to-analog (DAC) conversion and output signal coding method thereof, and more specifically to an iPWM-DAC apparatus to generate high SNR PWM signal and forming voltage and time domain differential signal coding for iPWM-DAC output.

BACKGROUND OF THE INVENTION

A Class-D audio amplifier is a switching amplifier or PWM amplifier. Class-D amplifier usually can provide high power efficiency over 90%, comparison to the 50% provided by conventional linear amplifier. To obtain a high-SNR Class-D amplifier, a feedback loop is often included. FIG. 1 shows a schematic view of a conventional Class-D amplifier. As shown in FIG. 1, Class-D amplifier is embodied by a PWM generator 102 and a noise shaping sigma-delta modulator 101, wherein the PWM generator 102 outputs complementary signals to a power driver 103 and through a filter 104 to drive a load. The drawback of the above embodiment is that sigma-delta modulation suffers stability problem and the modulator output signal gain is less than 1.

FIG. 2 and FIG. 3 show schematic views of a conventional PWM generator and corresponding waveform of the conventional PWM generator respectively. As shown in FIG. 2, the input of modulating digital audio signal $S(\theta)=B\sin(\theta)$, where $0\leq B\leq 1$, is modulated by a differential PWM generator. The PWM sample-rate is defined as $\omega_c=M\omega_s$, where M is an integer greater than 2. FIG. 3 shows a schematic view of the waveform of digital audio input and output signal Vo of the digital differential PWM, generator, where Vo=DP−DN, and output signal Vo can be expressed as Fourier series:

$$V_0(\theta)=\Sigma_{n=1}^{\infty}[A_n\cos(n\theta)+B_n\sin(n\theta)] \tag{1}$$

Where $$A_n = 2V_{CC}\sum_{k=0}^{M-1}\frac{\mathrm{Sign}\left(s\left(\frac{2\pi k}{M}\right)\right)}{n\pi}\left[\cos\left(\frac{2\pi nk}{M}\right)\sin\left(\frac{n\pi B\left|s\left(\frac{2\pi k}{M}\right)\right|}{M}\right)\right] \tag{2}$$

$$B_n = 2V_{CC}\sum_{k=0}^{M-1}\frac{\mathrm{Sign}\left(s\left(\frac{2\pi k}{M}\right)\right)}{n\pi}\left[\sin\left(\frac{2\pi nk}{M}\right)\sin\left(\frac{n\pi B\left|s\left(\frac{2\pi k}{M}\right)\right|}{M}\right)\right] \tag{3}$$

FIG. 4 shows a schematic view of an N-bit digital PWM converter, and FIG. 5 shows a schematic view of an N-bit digital word representing quantized signal Q and resulted quantization error, where error=Q−S. As shown in FIG. 4, the N-bit PWM converter includes a numerical quantized unit 301 and a D-to-T (D→T) convertor 302 for converting a digital value to a time pulse width. The maximum amplitude of input ramp signal S is defined as U. The quantization can be expressed as:

$$Q=U\times B_{in} \tag{4}$$

$$B_{in}=b_1 2^{-1}+b_2 2^{-2}+b_3 2^{-3}\ldots+b_n 2^{-n} \tag{5}$$

The minimum resolution of the quantized signal is:

$$Lsb = \frac{U}{2^N} \tag{6}$$

Referring to FIG. 3 and FIG. 5, the relation of maximum time-slot length 2π/M corresponding to the peak value U of input signal S and the relation of minimum level resolution Lsb mapped to minimum length resolution $L_{LSB}$ can be depicted in FIG. 6.

FIG. 7 shows a schematic view of quantization noise error $V_Q$. As shown in FIG. 7, $V_Q=L\times V_{cc}$, where L is the difference between minimum quantization length $L_{LSB}$ and minimum quantization resolution of Lsb.

Assume that the PWM output amplitude is unity, i.e., 1, and the N-bit word is only for expressing positive input value. The range of the error length is:

$$L\in\left[\frac{L_{Lsb}}{2},-\frac{L_{Lsb}}{2}\right],\ V_{CC}=1 \tag{7}$$

The rms value of the quantization noise signal, ⊃1], is given by $$V_{Q(rms)}=\left[\frac{1}{T}\int_{-T/2}^{T/2}V_Q^2 d\theta\right]^{0.5}=\left[\frac{1}{T}\int_{-T/2}^{T/2}L_{Lsb}^2\left(\frac{-\theta}{T}\right)^2 d\theta\right]^{0.5} \tag{8}$$

$$=\left[\frac{L_{Lsb}^2}{T^3}\left(\frac{\theta^3}{3}\Big|_{-T/2}^{T/2}\right)\right]^{0.5}=\frac{L_{LSB}}{\sqrt{12}} \tag{9}$$

Therefore, Quantization noise intensity rms is represented as:

$$V_{Q(rms)}=\frac{L_{Lsb}}{\sqrt{12}}=\frac{2\pi}{2^N M\sqrt{12}} \tag{10}$$

FIG. 8 shows a schematic view of comparison between a differential PWM-DAC and a sample-and-hold DAC. As shown in FIG. 8, the differential PWM-DAC outputs digital pulse and the sample-and-hold DAC outputs analog signal. The SNR of the PWM-DAC is derived as:

$$SNR = \tag{11}$$

$$20\log\left(\frac{\mathrm{Signal}_{rms}}{\mathrm{Noise}_{rms}}\right)=20\log\left(\frac{\frac{1}{2}\sqrt{A_1^2+B_1^2}}{\frac{2\pi}{2^N M\sqrt{12}}}\right)=20\log\left(\frac{2^N MC_1\sqrt{12}}{4\pi}\right)$$

$$SNR=6.02N+20\log(MC_1)-11.18\ \mathrm{dB} \tag{12}$$

Where $$C_1=\sqrt{A_1^2+B_1^2} \tag{13}$$

$$A_1=\sum_{k=0}^{M-1}\frac{2\mathrm{Sign}\left(s\left(\frac{2\pi k}{M}\right)\right)}{\pi}\left[\cos\left(\frac{2\pi k}{M}\right)\sin\left(\frac{\pi B\left|s\left(\frac{2\pi k}{M}\right)\right|}{M}\right)\right] \tag{14}$$

-continued $$B_1 = \sum_{k=0}^{M-1} \frac{2\mathrm{Sign}\left(s\left(\frac{2\pi k}{M}\right)\right)}{n\pi}\left[\sin\left(\frac{2\pi k}{M}\right)\sin\left(\frac{\pi B\left|s\left(\frac{2\pi k}{M}\right)\right|}{M}\right)\right] \quad (15)$$

In contrast, the SNR for the sample-and-hold DAC is 6.02N+10 log(M)+1.76 dB.

The SNR of differential PWM-DAC is a function of quantization bit-N, over sample-rate M and input modulating signal band-width BW. FIG. 9 shows a schematic plot of the SNR corresponding input signal's BW and PWM sample-rate $\omega_c = M\omega_s$ when N is set as 14 bits. As shown in FIG. 9, in order to maintain SNR>100 dB for differential PWM output with respect to audio band-width 20 Khz, where M=25, BW=20 Khz, N=14:

$$PVM\ DAC\ SNR = 6.02N + 20\log(M) - 11.18\ \mathrm{dB} = 6.02 \times 14 + 20\log(25) - 11.18\ \mathrm{dB} = 101\ \mathrm{dB} \quad (16)$$

There is a critical choice for minimum-time-resolution (or minimum-time-slot) of differential PWM as shown in FIG. 7:

$$\text{Minimum Time resolution } T_R = \frac{1}{2^N M \times BW}\sec \quad (17)$$

$$T_R = \frac{1}{8.192\ \mathrm{Ghz}}\sec = 122\ \mathrm{ps} \quad (18)$$

As revealed in equation (16), the minimum-time-resolution should reach 122 ps to guarantee SNR greater than 100 dB. This is very short pulse-width for differential PWM implementation and may raise two issues. The first issue is how to generate this short pulse while lowering the power consumption and cost; and the second issue is that the next stage of differential PWM output is a power driver stage, which will cause the short pulse diminished when signal pass through the power driver due to the dead-time and power MOS's parasitic capacitor, as shown in FIG. 10.

Thus, it is imperative to devise a solution to address the aforementioned issues.

SUMMARY OF THE INVENTION

The present invention has been made to overcome the above-mentioned drawback of conventional PWM digital-to-analog (DAC) convertor. The primary object of the present invention is to provide a differential interpolation pulse width modulation (iPWM) digital to analog converter able to generate exceed 100 dB signal-to-noise ratio SNR of PWM signal.

To achieve the above objects, the present invention provides a differential interpolation pulse width modulation (iPWM) digital to analog converter, including an iPWM module for generating differential pulses from an input digital audio data stream, a power driver for providing energy to a terminal load and a filter for removing unwanted harmonic signals to reconstruct an analog signal, wherein the iPWM module further includes a PWM pulse generator to convert the digital input numerical code to a series of time domain pulses; an interpolation unit to increase the time domain resolution of the time domain pulses; a self-calibration unit to maintain the pulse-width accuracy of the interpolation unit; a differential pulse width generator to convert the series of time domain pulses into voltage and time domain differential form.

In another exemplary embodiment, the present invention provides a PWM signal coding scheme for the iPWM module to determine a number of interpolation resolution bits K for an input signal S quantized into an N-bit representation including a 1-bit sign, a J-bit MSB part and a K-bit LSB part, wherein N=J+K, $$K = \log_2\left\lfloor\frac{T_P}{T_R}\right\rfloor,$$

$T_P$ is a minimum pulse-width that can pass through a power drive without diminishing and $T_R$ is the minimum time resolution of the input signal S. Specifically, the iPWM module outputs a DP pulse and a DN pulse, and for S ranging from $-(2^N-1)$ to $(2^N-1)$, the signal coding scheme defines Vo=DP−DN so that for any value S, $Vo = S*T_R$.

In yet another exemplary embodiment, the present invention provides a pulse-width interpolation method for the iPWM module, including the steps of: selecting PWM sample rate M to determine number of bits N required; selecting a minimum pulse-width $T_P$ able to pass through a power driver stage without diminishing; determining minimum time resolution $T_R$; determining a number of interpolation resolution bits K for input signal S quantized into an N-bit representation including a 1-bit sign, a J-bit MSB part and a K-bit LSB part, wherein N=J+K, $$K = \log_2\left\lfloor\frac{T_P}{T_R}\right\rfloor,$$

and $T_R$ being the minimum time resolution of the input signal S; and outputting interpolation pulses DP and DN of designated width.

The foregoing and other objects, features, aspects and advantages of the present invention will become better understood from a careful reading of a detailed description provided herein below with appropriate reference to the accompanying drawings.

BRIEF DESCRIPTION OF THE DRAWINGS

The present invention can be understood in more detail by reading the subsequent detailed description in conjunction with the examples and references made to the accompanying drawings, wherein.

DETAILED DESCRIPTION OF THE PREFERRED EMBODIMENTS

Figure 1:
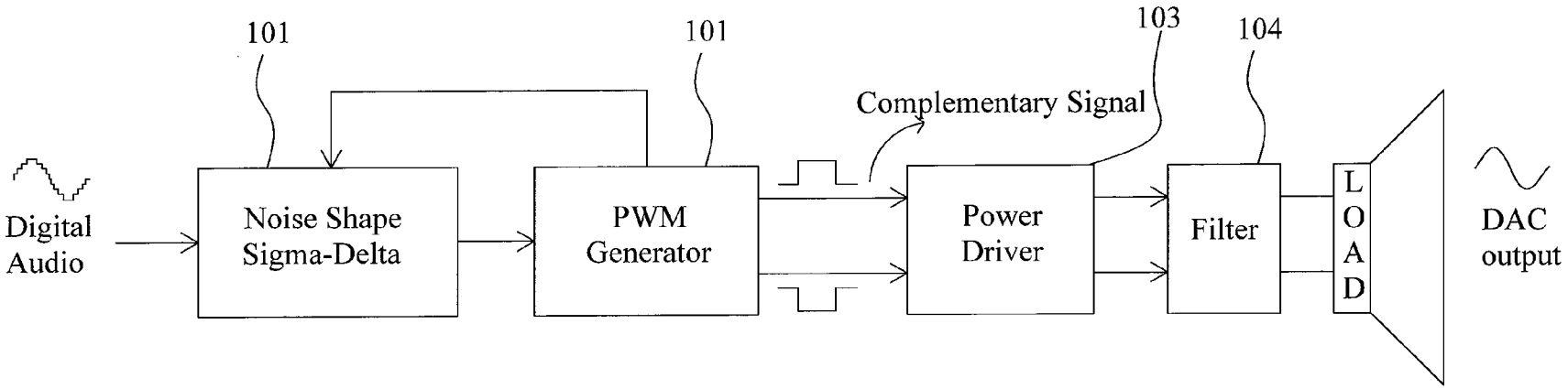
FIG. 1 (PRIOR ART)
FIG. 1 shows a schematic view of a conventional Class-D amplifier.
Figure 2:
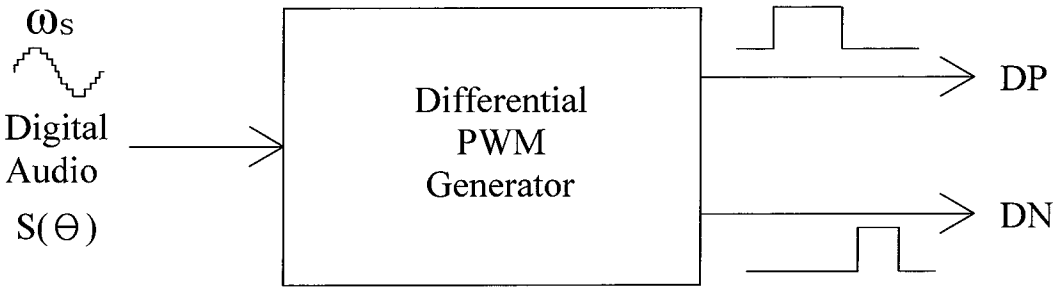
FIG. 2(PRIOR ART)
FIG. 2 shows a schematic view of a conventional PWM generator.
Figure 3:
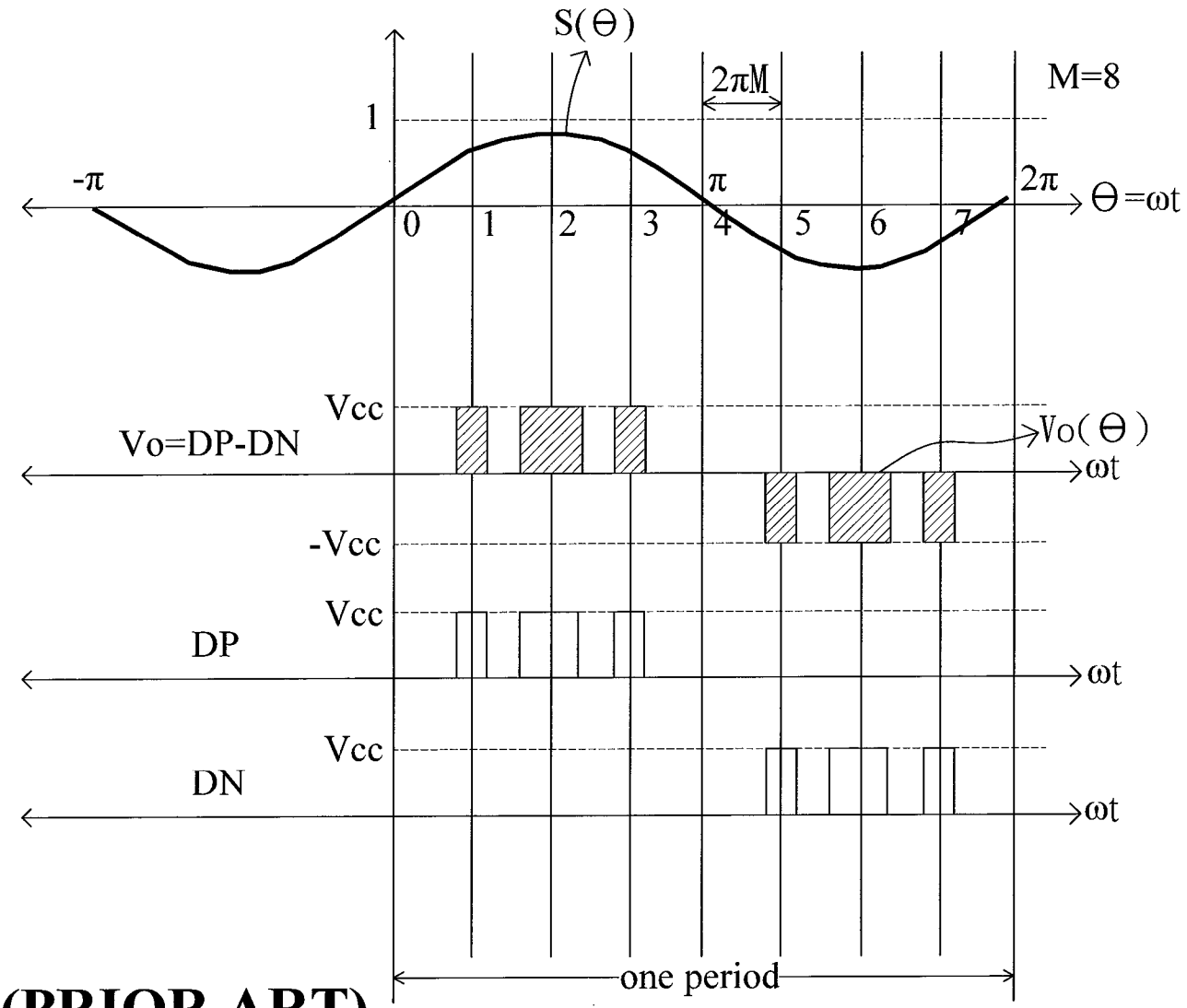
FIG. 3(PRIOR ART)
FIG. 3 shows a schematic view of waveform corresponding to the conventional PWM generator of FIG. 2.
Figure 4:
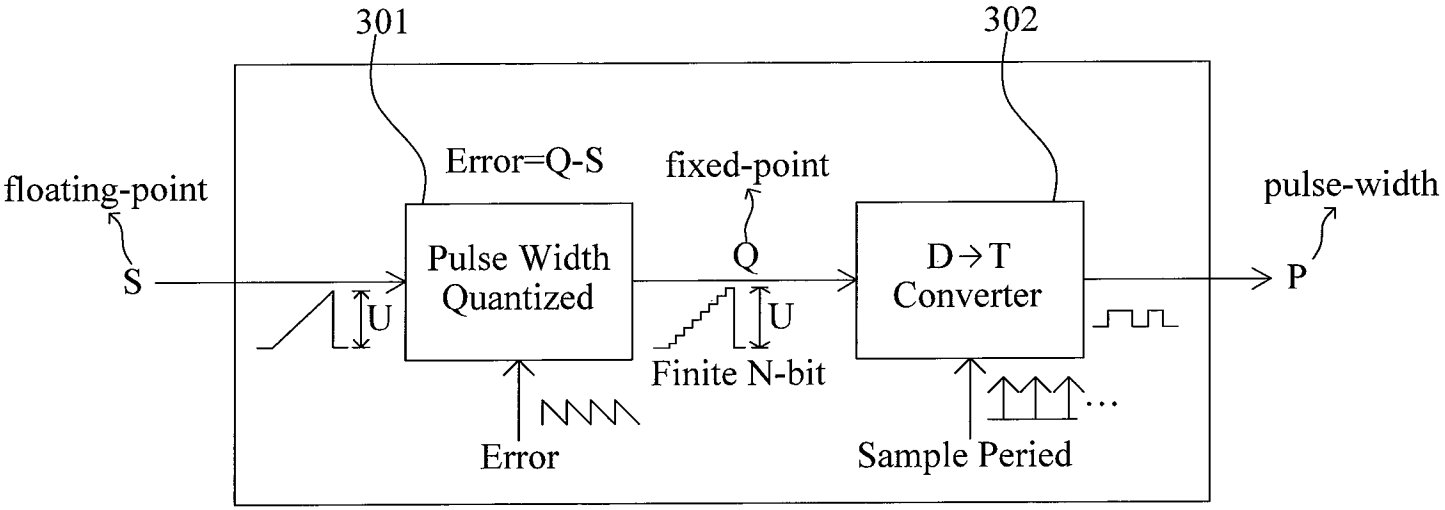
FIG. 4(PRIOR ART)
FIG. 4 shows a schematic view of an N-bit digital PWM converter.
Figure 5:
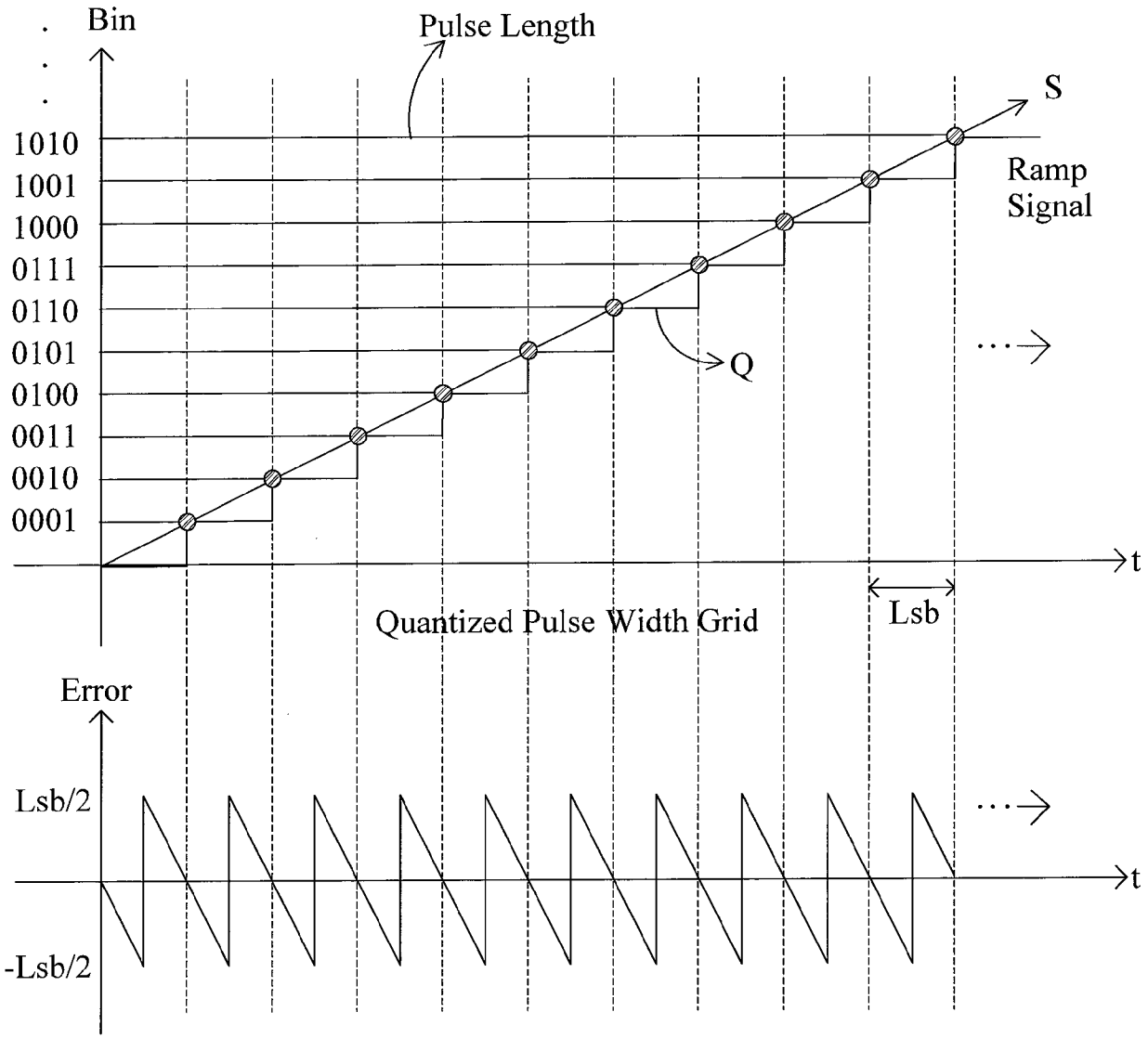
FIG. 5 (PRIOR ART)
FIG. 5 shows a schematic view of an N-bit digital word representing quantized signal Q and resulted quantization error.
Figure 6:
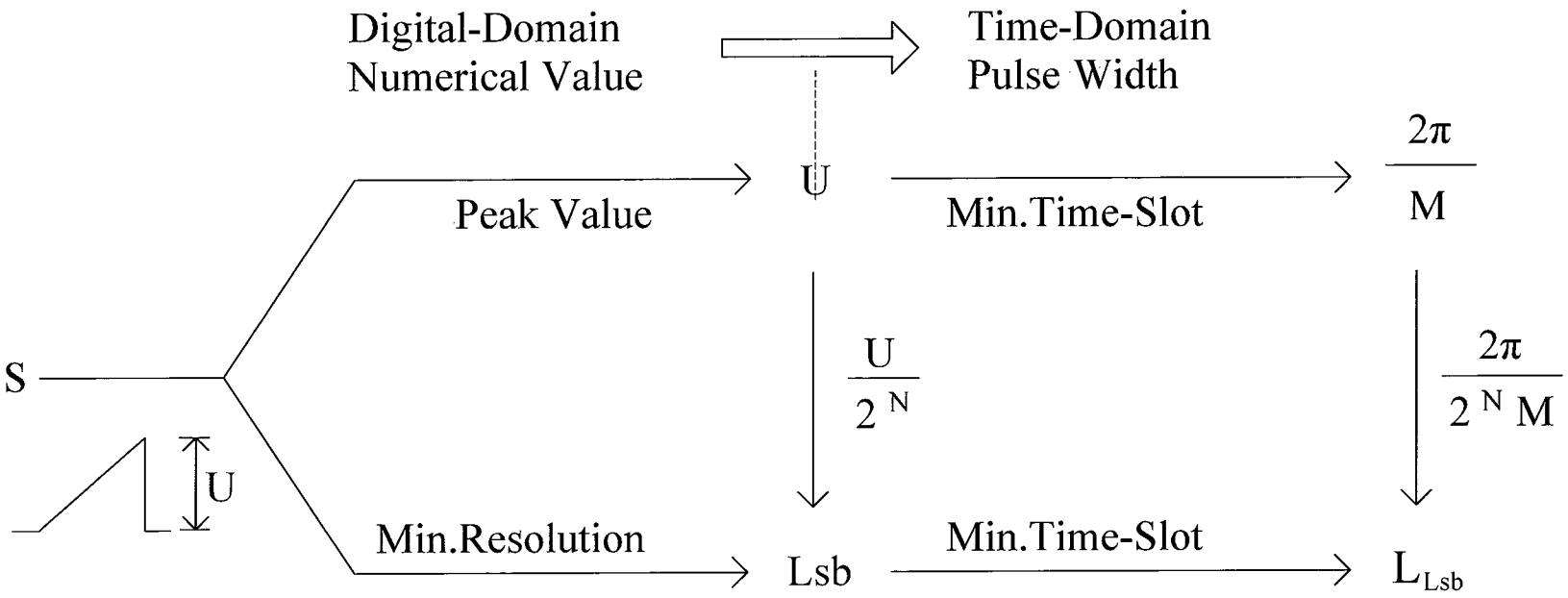
FIG. 6(PRIOR ART)
FIG. 6 shows a schematic view of the relation of maximum time-slot length 2π/M corresponding to the peak value U of input signal S and the relation of minimum level resolution Lsb mapped to minimum length resolution $L_{LSB}$.
Figure 7:
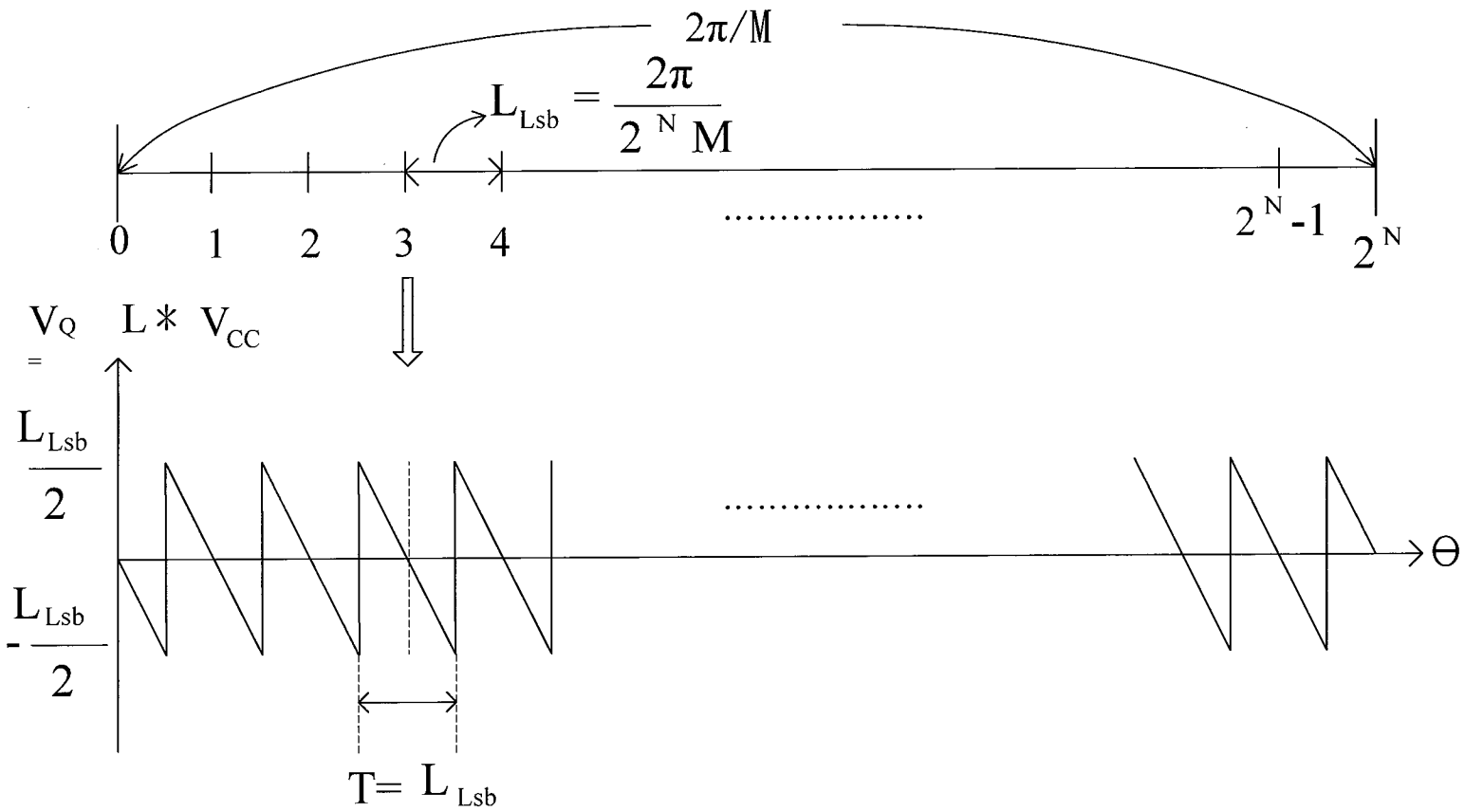
FIG. 7(PRIOR ART)
FIG. 7 shows a schematic view of quantization noise error.
Figure 8:
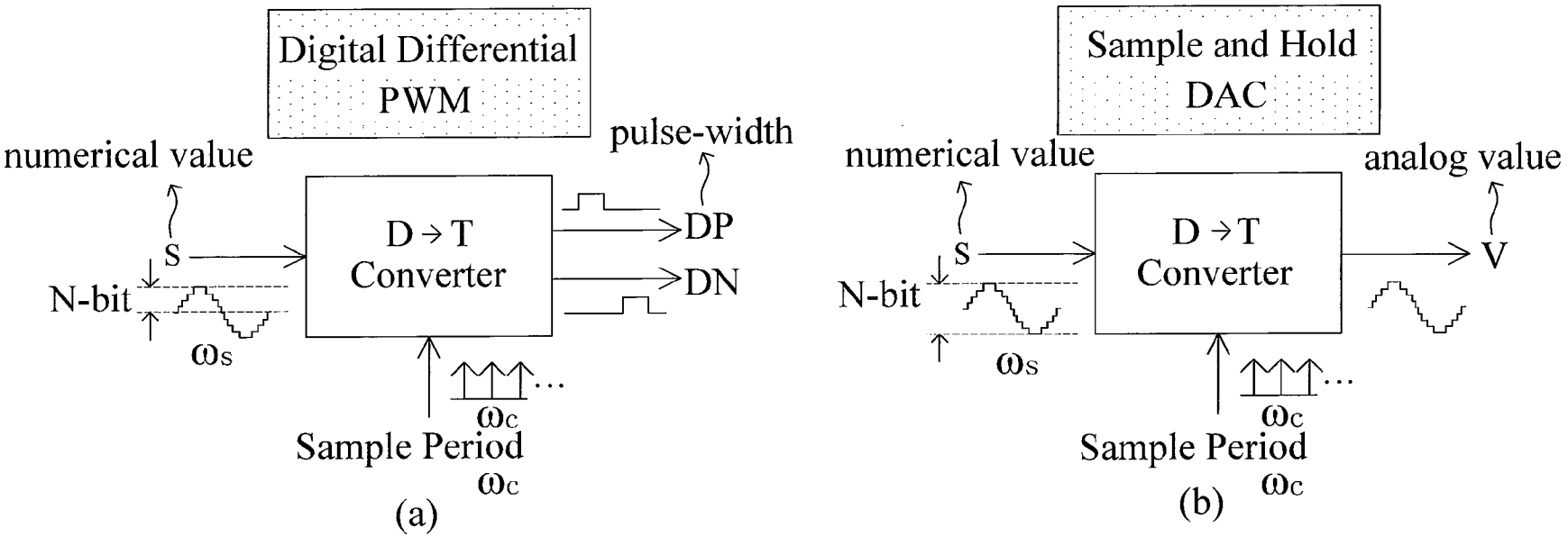
FIG. 8(PRIOR ART)
FIG. 8 shows a schematic view of comparison between a differential PWM-DAC and a sample-and-hold DAC.
Figure 9:
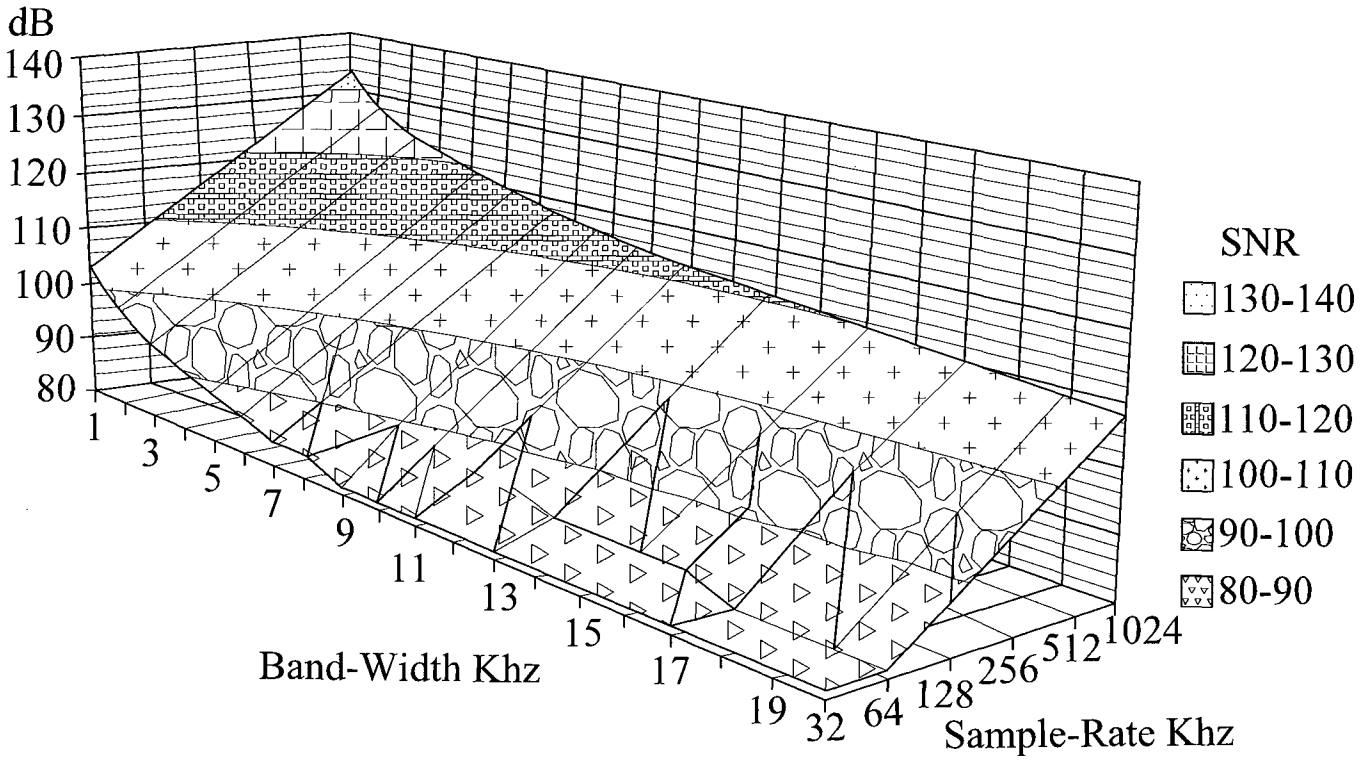
FIG. 9(PRIOR ART)
FIG. 9 shows a schematic plot of the SNR corresponding input signal's BW and PWM sample-rate.
Figure 10:
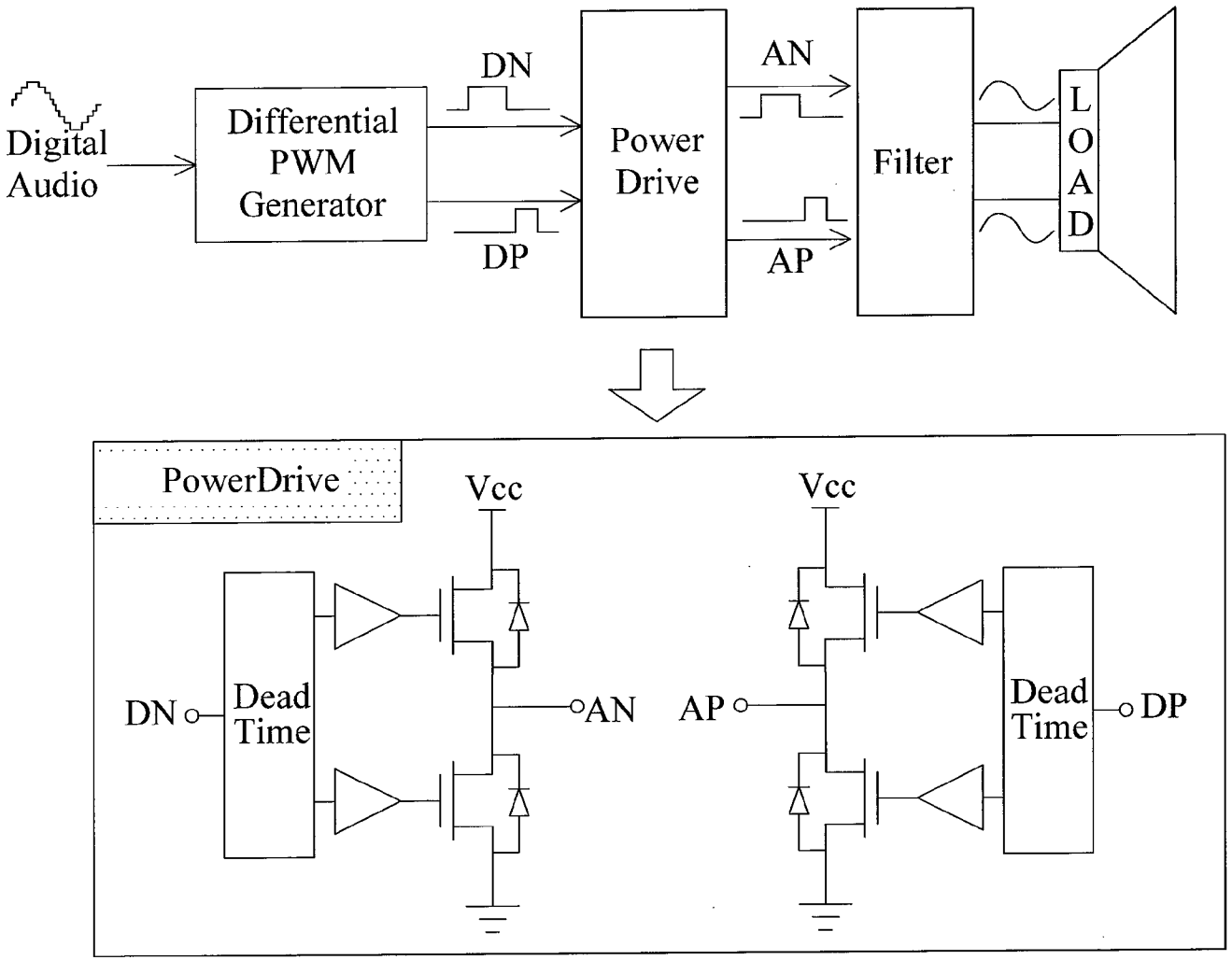
FIG. 10 shows a schematic view of short pulse diminished when signal pass through a power driver.
Figure 11:
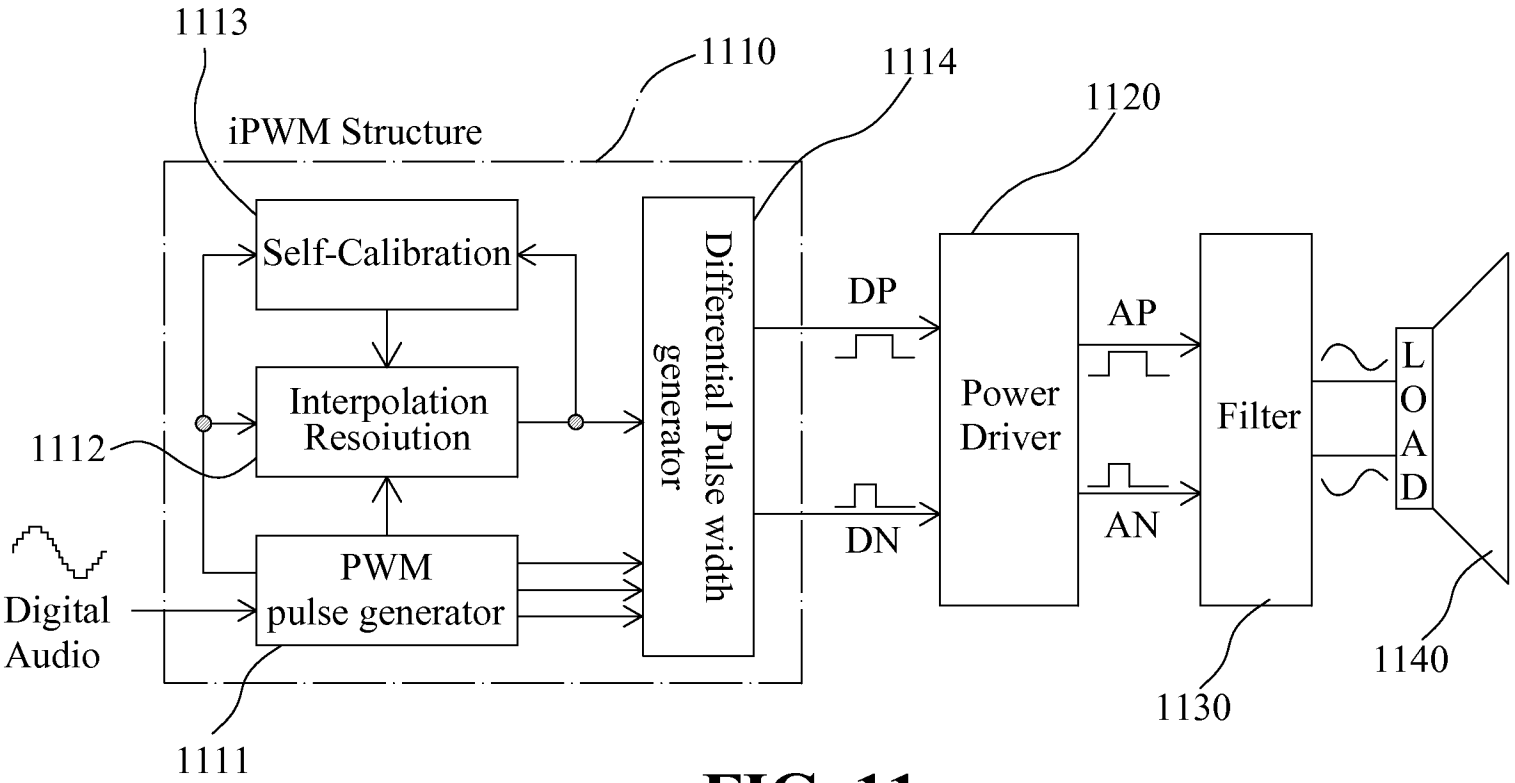
FIG. 11 shows a schematic view of an iPWM DAC according to the invention.

FIG. 11 shows a schematic view of a differential interpolation pulse width modulation (iPWM) DAC according to the invention. As shown in FIG. 11, the iPWM DAC includes an iPWM module 1110, a power drive stage 1120 and a filter 1130, wherein iPWM module 1110 is connected to a digital audio input and filter 1130 is connected to a terminal load 1140, for example, a speaker. iPWM module 1110 generates differential pulses according to the data stream from the digital audio input, power driver stage 1120 provides power to terminal load 1140 and filter 1130 removes unwanted harmonic signals to reconstruct an analog signal outputted to terminal load 1140. iPWM module further includes a PWM pulse generator 1111, an interpolation resolution unit 1112, a self-calibration unit 1113 and a differential pulse width generator 1114, wherein PWM pulse generator 1111 converts the digital audio input to a series of time domain pulses with width; interpolation resolution unit 1112 increases the time domain resolution of the pulses; self-calibration unit 1113 maintains the pulse-width accuracy of interpolation resolution unit 1112; and differential pulse width generator 1114 converts the series of time domain pulses into voltage and time domain differential form.

As aforementioned in equations (16), (17) and (18), the minimum-time-resolution should reach 122 ps in order to guarantee SNR greater than 100 dB, and the short pulse-width is deemed to diminish when passing a power driver stage, which is connected to iPWM module 1110 because of the dead-time and power MOS's parasitic capacitor. The following describes an exemplary embodiment to address the above design issue.

Figure 12A:
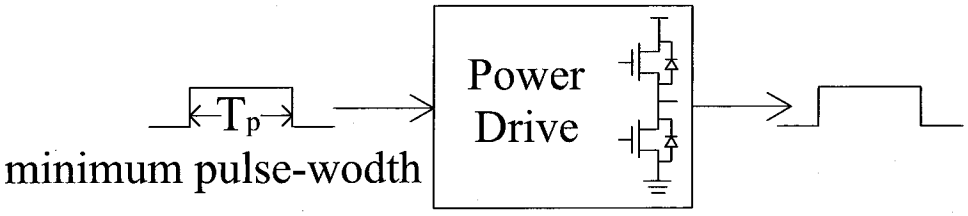
FIG. 12*a* shows a schematic view of a minimum pulse width defined according to the present invention.
Figure 12B:
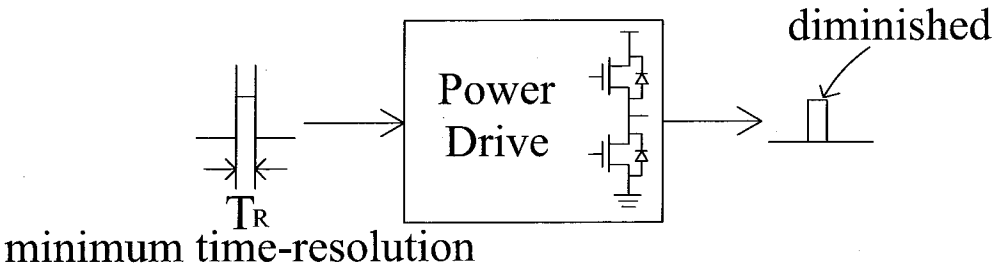
FIG. 12*b* shows a schematic view of a minimum time resolution defined according to the present invention.

FIG. 12*a* and FIG. 12*b* show schematic views of a minimum pulse width and minimum time resolution defined according to the present invention respectively. As shown in FIG. 12*a* and FIG. 12*b*, $T_p$ is defined as the minimum pulse width able to pass through the power driver stage 1120 without diminishing, and $T_R$ is defined as the minimum time resolution of the digital audio input.

Figure 13:
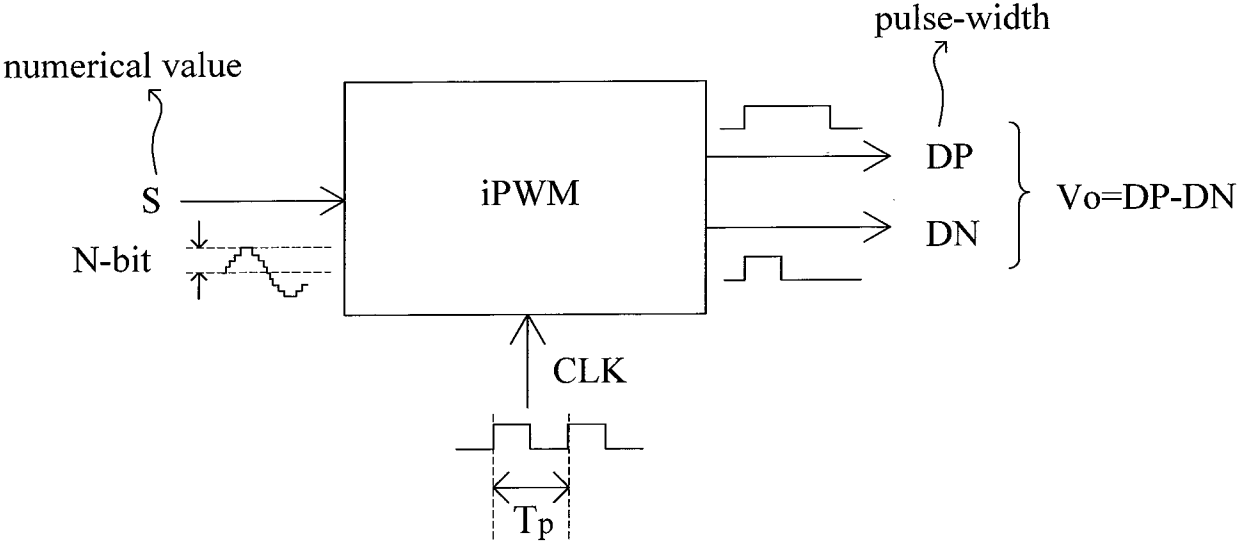
FIG. 13 shows a schematic view of iPWM module according to the present invention.

FIG. 13 shows a schematic view of iPWM module according to the present invention, where S is digital audio input and DP and DN are pulse output with width. In addition, Vo is defined as DP−DN, i.e., the subtraction of the two pulses. iPWM module 1110 is operated at a clock with a period of $T_P$.

Because digital audio input S is quantized as N-bit numeric values, including a 1-bit sign, a J-bit MSB part and a K-bit LSB part, wherein N=J+K, $$K = \log_2\left\lfloor \frac{T_P}{T_R} \right\rfloor,$$

and $T_R$ being the minimum time resolution of the input signal S; the number of interpolation bits K can be determined by computing $$K = \log_2\left\lfloor \frac{T_P}{T_R} \right\rfloor.$$

Figure 14:
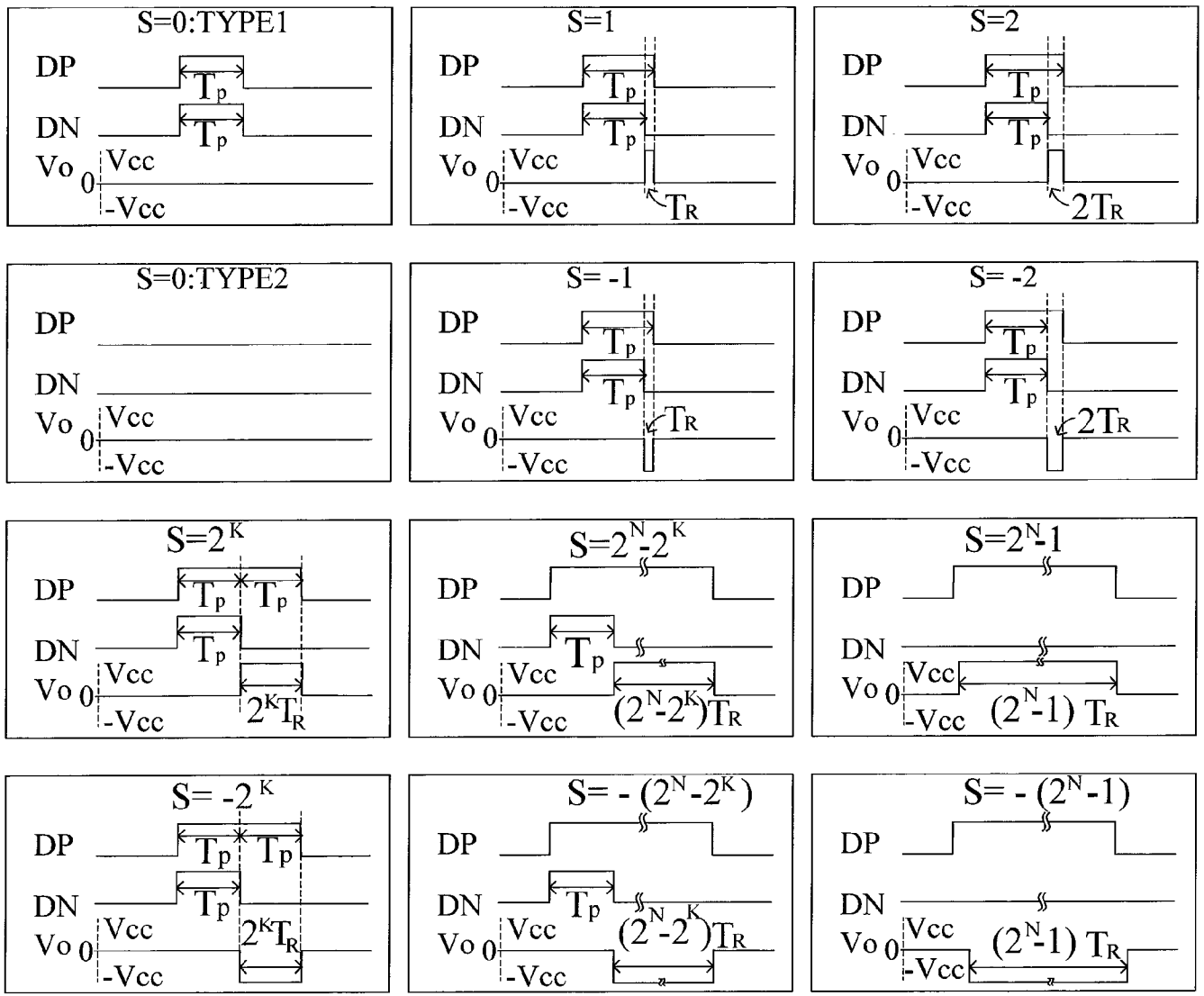
FIG. 14 shows a waveform table of a single-sided expanded iPWM coding scheme according to the present invention.
Figure 15:
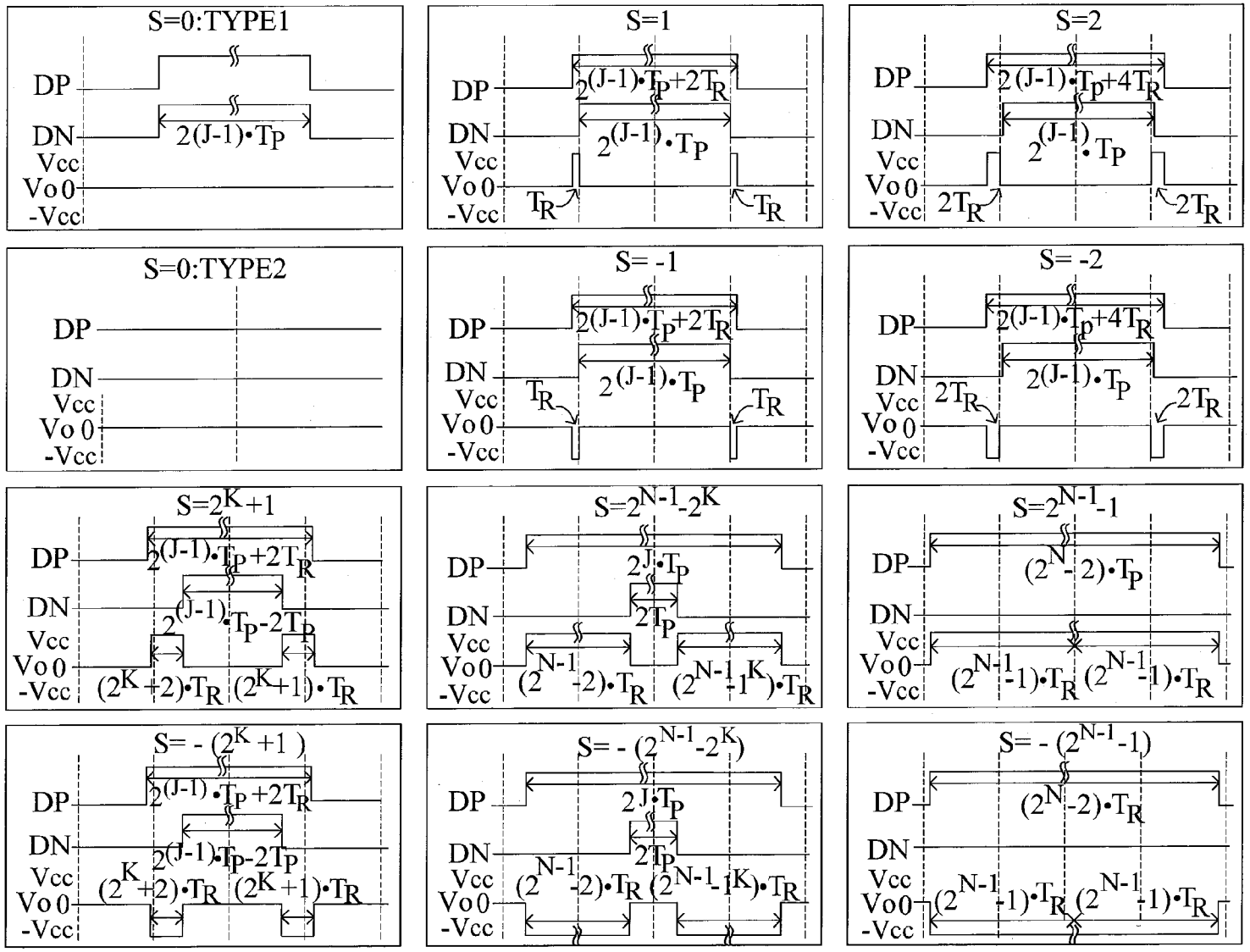
FIG. 15 shows a waveform table of a double-sided expanded iPWM coding scheme according to the present invention.
Figure 16:
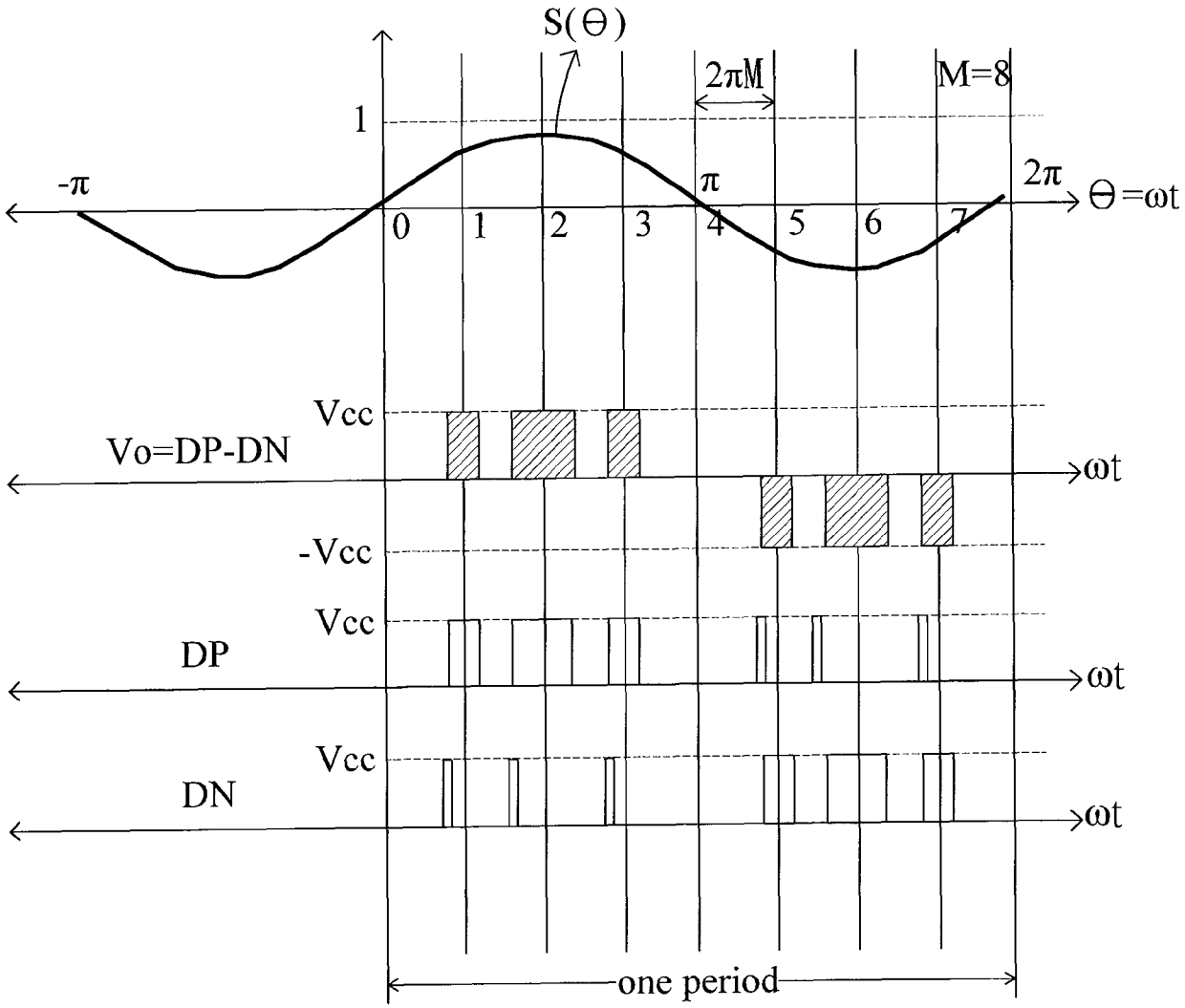
FIG. 16 shows a schematic view of a period of pulses outputted by iPWM module according to the present invention.

FIG. 14 shows a waveform table of a single-sided expanded iPWM coding scheme and FIG. 15 shows a waveform table of a double-sided expanded iPWM coding scheme. Both coding schemes can be used as pulses of designated width generated by the iPWM module of the present invention. As shown in FIG. 14, for S=0, there are two possible codings; in other words, both DP and DN are pulses with width $T_P$, or both DP and DN are pulses with width zero, i.e., no pulses. As shown in FIG. 14, the leading edge of DP and the leading edge of DN occur at the same time. In either coding cases, Vo=DP−DN=0. Similarly, for other numeric values of S, Vo=DP−DN=S*$T_R$. The double-sided expanded iPWM coding scheme of FIG. 15 is similar to the single-sided expanded iPWM coding scheme of FIG. 14, except that the Vo is symmetrically expanded from two sides, as shown in FIG. 15. In other words, the mid-point of DP and mid-point of DN coincide. Therefore, Vo=DP−DN=2*S*$T_R$. In addition, FIG. 16 shows a schematic view of a period of pulses outputted by iPWM module according to the present invention.

Figure 17:
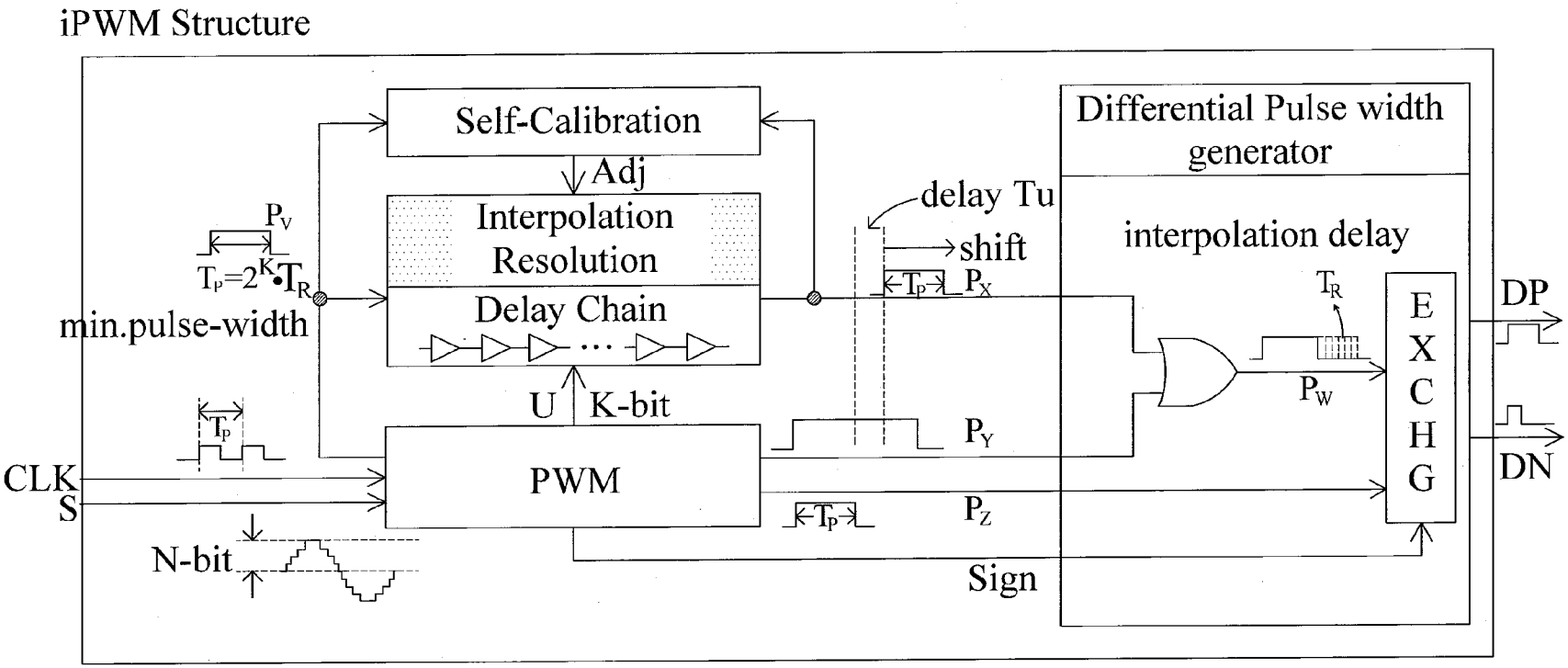
FIG. 17 shows a detailed view of an embodiment of the iPWM module according to the present invention.

FIG. 17 shows a detailed view of an embodiment of the iPWM module according to the present invention. As shown in FIG. 17, interpolation resolution unit 1112 can be implemented as a delay chain and self-calibration unit 1113 performs a minimum pulse width calibration to ensure that minimum time resolution of interpolation resolution unit 1112 is precisely $T_R$. During the calibration stage, self-calibration unit 1113 adjusts the delay-chain of the interpolation resolution unit which is controlled by Adj signal to keep time delay $T_U$=$T_P$. During normal operation stage, the input signal S's numerical part X is defined from 0 to $2^k$−1, interpolation resolution unit 1112 generates extra time resolution, following the proportion ratio of calibration signal Adj. The number of delay tape (ND) corresponding to this numerical part X is defined as:

$$ND = \left[Adj \cdot \frac{X}{2^k} \cdot \frac{T_u}{T_P}\right].$$

Obviously, the higher the number of ND, the more accurate the interpolation resolution will be. For instance: Adj=100, k=8, X=$2^3$. The derived relative ND=3.

Figure 18:
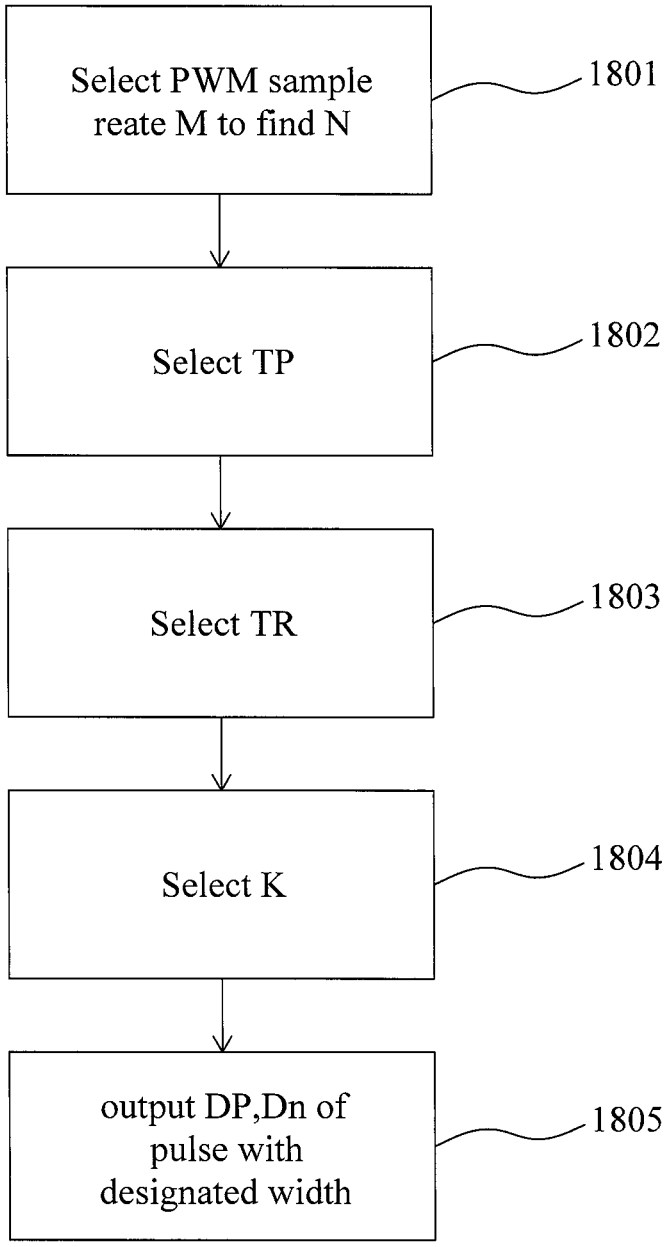
FIG. 18 shows a flowchart of a pulse-width interpolation method for iPWM according to the present invention.

FIG. 18 shows a flowchart of a pulse-width interpolation method for iPWM according to the present invention. As shown in FIG. 18, step 1801 is to select a PWM sample rate M to determine number of bits N required. For example, for audio bandwidth BW=20 khz, SNR>100 dB, connecting to a 2 W power drive stage. When the PWM sample rate is selected as 500 khz, M=500/20=25. Following equation (16), the N can be determined as: SNR=6.02N+20 log(M)−11.18 dB, which results in N>13.92. Thus, N is determined to be 14 bits.

Step 1802 is to select a minimum pulse-width $T_P$ able to pass through a power driver stage without diminishing. Following the above example, $T_P$ is selected as 31.25 ns because in general, the minimum pulse-width is preferably greater than 30 ns.

Step 1803 is to determine the minimum time resolution $T_R$, as $$T_R = \frac{1}{2^N M \times BW}\sec = \frac{1}{16384 \times 25 \times 20K} = 122 \text{ ps}$$

Step 1804 is to determine a number of interpolation resolution bits K for input signal S quantized into an N-bit representation including a 1-bit sign, a J-bit MSB part and a K-bit LSB part, wherein N=J+K, $$K = \log_2\left\lfloor \frac{T_P}{T_R} \right\rfloor,$$

and $T_R$ being the minimum time resolution of the input signal S. Following the above example, $$K = \log_2\left\lfloor \frac{T_P}{T_R} \right\rfloor = \log_2\left\lfloor \frac{31.25 \text{ ns}}{122 \text{ ps}} \right\rfloor = 8\text{-bit}.$$

Thus, J=N−K=14−8=6-bit.

Step 1805 is to output interpolation pulses DP and DN of designated width. For example, the pulses can have designated width by using the single-sided expanded iPWM coding scheme of FIG. 14 or double-sided expanded iPWM coding scheme of FIG. 15.

Although the present invention has been described with reference to the preferred embodiments, it will be understood that the invention is not limited to the details described thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A differential interpolation pulse width modulation (iPWM) DAC apparatus, connected to an input digital audio data stream, comprising:

an iPWM module for generating differential pulses from said input digital audio data stream;

a power driver, connected to said iPWM module, for providing energy to a terminal load; and a filter, connected to said power driver, for removing unwanted harmonic signals to reconstruct an analog signal before outputting to said terminal load;

wherein said iPWM module further comprising:

a pulse width modulation (PWM) pulse generator to receive and convert said input digital audio data stream to a series of time domain pulses;

an interpolation resolution unit, connected to said PWM pulse generator, to increase the time domain resolution of said time domain pulses;

a self-calibration unit, connected to said interpolation resolution unit, to maintain the pulse-width accuracy of said interpolation resolution unit; and a differential pulse width generator, connected to said PWM pulse generator and said interpolation resolution unit, to convert said series of time domain pulses into voltage and time domain differential form.

2. The apparatus as claimed in claim 1, wherein said differential pulse width generator outputs pulse DP and pulse DN to said power driver, and widths of said pulse DP and said pulse DN are determined by said iPWM module.

3. The apparatus as claimed in claim 1, wherein said iPWM module uses a PWM signal coding scheme to determine a number of interpolation resolution bits K for an input signal S quantized into an N-bit representation having a 1-bit sign, a J-bit MSB part and a K-bit LSB part, wherein N=J+K, $$K = \log_2\left\lfloor \frac{T_P}{T_R} \right\rfloor,$$

$T_P$ is a minimum pulse-width able to pass through said power driver without diminishing and $T_R$ is the minimum time resolution of the input signal S, wherein the iPWM module outputs a DP pulse and a DN pulse, and for S ranging from $-(2^N-1)$ to $(2^N-1)$, the PWM signal coding scheme defines Vo=DP−DN so that for any value S, $Vo=S*T_R$.

* * * * *